United States Patent [19]

Villari et al.

[11] 4,402,312

[45] Sep. 6, 1983

[54] COMPRESSION DEVICE

[75] Inventors: Frank K. Villari, Oak Park; Larry D. Annis, Elgin; Goldie J. Westgaard, Prairie View, all of Ill.

[73] Assignee: The Kendall Company, Boston, Mass.

[21] Appl. No.: 294,959

[22] Filed: Aug. 21, 1981

[51] Int. Cl.[3] ..... A61H 1/00

[52] U.S. Cl. ..... 128/24 R; 128/64

[58] Field of Search ..... 128/64, 24, 40, 38; 272/130; 5/449, 456

[56] References Cited

U.S. PATENT DOCUMENTS

| | | | |
|---|---|---|---|
| 1,795,304 | 3/1931 | Howard | 272/130 X |
| 3,548,809 | 12/1970 | Conti | 128/64 |
| 4,253,449 | 3/1981 | Arkans | 128/64 |

*Primary Examiner*—Richard J. Apley

*Assistant Examiner*—David J. Brown

*Attorney, Agent, or Firm*—Powell L. Sprunger

[57] ABSTRACT

A device for applying compressive pressures against a patient's limb from a source of pressurized fluid comprising, an elongated pressure sleeve for enclosing a length of the patient's limb. The sleeve has a plurality of sets of adjoining laterally extending fluid pressure chambers, with the sets being progressively arranged longitudinally along the sleeve from a lower portion of the limb to an upper portion of the limb proximal the patient's heart relative to the lower portion. The sleeve has an opening communicating between a lower and an upper chamber in each of the sets. The device has a plurality of conduits separately communicating with the lower chambers in each of the sets, and a device for intermittently inflating the chambers through the conduits and for intermittently deflating the chambers.

3 Claims, 4 Drawing Figures

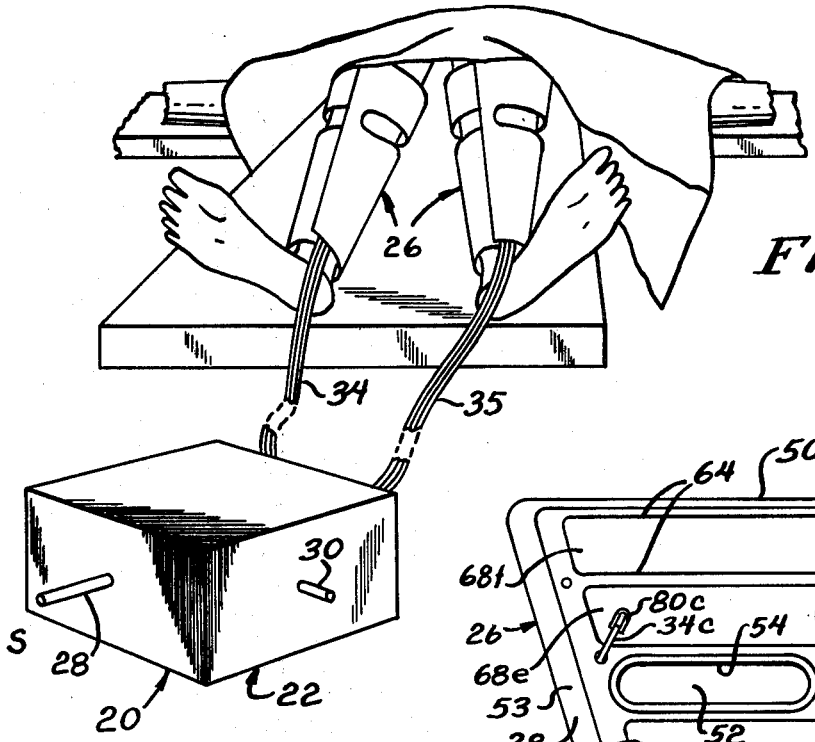
FIG. 1
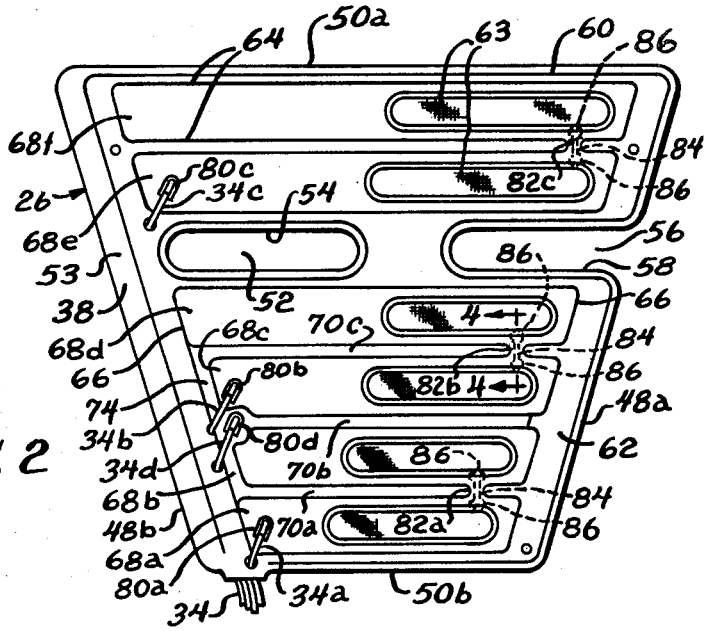
FIG. 2
FIG. 3
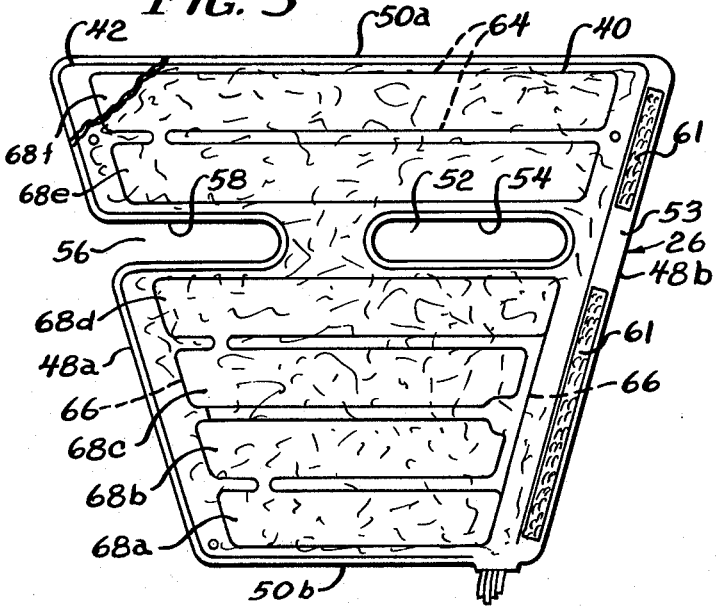
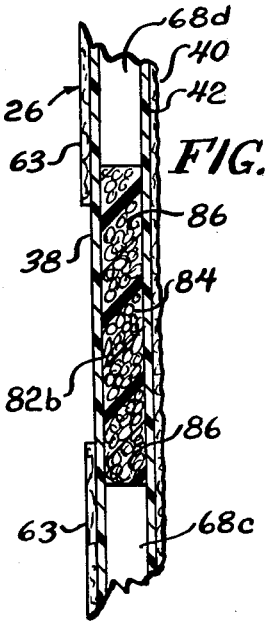
FIG. 4

COMPRESSION DEVICE

BACKGROUND OF THE INVENTION

The present invention relates to therapeutic and prophylactic devices, and more particularly to devices for applying compressive pressures against a patient's limb.

It is known that the velocity of blood flow in a patient's extremities, particularly the legs, markedly decreases during confinement of the patient. Such pooling or stasis of blood is particularly pronounced during surgery, immediately after surgery, and when the patient has been confined to bed for extended periods of time. It is also known that stasis of blood is a significant cause leading to the formation of thrombi in the patient's extremities, which may have a severe deleterious effect on the patient, including death. Additionally, in certain patients it is desirable to move fluid out of interstitial spaces in extremity tissues, in order to reduce swelling associated with edema in the extremities.

Devices have been disclosed in U.S. Pat. Nos. 4,013,069 and 4,030,488, incorporated herein by reference, which develop and apply the desired compressive pressures against the patient's limbs. Such devices comprise a pair of sleeves which envelope the patient's limbs, and a controller for supplying fluid pressure to the sleeves. However, it is desirable to simplify the structure of these devices to reduce their cost to the patient.

SUMMARY OF THE INVENTION

The principal feature of the present invention is the provision of an improved device for applying compressive pressures from a source of pressurized fluid against a patient's limb.

The device comprises an elongated pressure sleeve for enclosing a length of the patient's limb, with the sleeve having a plurality of sets of adjoining laterally extending fluid pressure chambers. The sets are progressively arranged longitudinally along the sleeve from a lower portion of the limb to an upper portion of the limb proximal the patient's heart relative to the lower portion. The sleeve has an opening communicating between a lower and upper chamber in each of the sets. The device has a plurality of conduits separately communicating with the lower chambers in each of the sets, and means for intermittently inflating the chambers through the conduits and for intermittently deflating the chambers.

A feature of the present invention is that the lower chambers in each of the sets are inflated through the conduits.

Another feature of the invention is that the upper chambers in each of the sets are inflated through the openings from the lower chambers.

Yet another feature of the invention is that the inflated chambers develop a pressure gradient against the patient's limb which decreases from the lower portion of the sleeve to the upper portion of the sleeve.

Still another feature of the invention is that the device is of simplified construction and reduced cost.

Further features will become more fully apparent in the following description of the embodiments of this invention and from the appended claims.

DESCRIPTION OF THE DRAWINGS

In the drawings:

FIG. 1 is a fragmentary perspective view of a compressive pressure device of the present invention;

FIG. 2 is a front plan view of a compression sleeve for the device of FIG. 1;

FIG. 3 is a back plan view of the sleeve of FIG. 2; and

FIG. 4 is a fragmentary sectional view taken substantially as indicated along the line 4—4 of FIG. 2.

DESCRIPTION OF THE PREFERRED EMBODIMENTS

Referring now to FIG. 1, there is shown an intermittent compression device generally designated 20 having a controller 22, and a pair of elongated compression sleeves 26 for enclosing a length of the patient's extremities, such as the legs as shown. The controller 22 is connected through a tube 28 to a source S of pressurized gas, and to an exhaust tube 30. Also, the controller 22 is connected to the separate sleeves 26 through separate sets of conduits 34 and 35. The controller 22 may be of any suitable type, such as the controllers described in U.S. Pat. Nos. 4,013,069 and 4,030,488.

With reference to FIGS. 2 and 3, the sleeve 26 has an outer fluid impervious barrier sheet 38. Also, the sleeve 26 has an inner cover sheet 40 covering an inner surface of an inner fluid impervious barrier sheet 42. The inner cover sheet 40 may comprise a suitable nonwoven material which provides a comfortable inner surface of the sleeve 26 for the patient. The barrier sheets may be formed from a suitable flexible plastic material, such as polyvinylchloride.

The sleeve 26 may have a pair of side edges **48*a* and 48*b*, and a pair of end edges 50*a* and 50*b* connecting the side edges 48*a* and *b*, with the side edges 48*a* and *b* being tapered toward a lower end of the sleeve. The sleeve 26 may also have an elongated opening 52 extending through a knee region 53 of the sleeve, and defined by peripheral edges 54 extending around the opening 52. In addition, the sleeve 26 has an elongated opening or cut-out 56 in the knee region 53 extending from the side edge 48*a* toward a lateral central portion of the sleeve, with the opening 56 being defined by peripheral edges 58 extending from the side edge 48*a* around the opening 56. As shown, the inner end of the opening 56 is spaced from the opening 54, and the opening 56 defines an upper flap 60 and a lower flap 62 of the sleeve which are separated by the opening 56. Further, the sleeve 26 may have a pair of lower fastening strips 61, such as a hook material sold under the trademark Velcro, secured to the inner cover sheet 40 along the side edge 48*b*, and a plurality of spaced strips 63 extending laterally on the outer barrier sheet 38**, such as a loop material sold under the trademark Velcro.

The inner and outer fluid imprevious barrier sheets 42 and 38 have a plurality of laterally extending lines 64, such as lines of sealing, connecting the barrier sheets 38 and 42 together, and longitudinally extending lines 66, such as lines of sealing, connecting the sheets 38 and 42 together and connecting ends of the lateral lines 64, as shown. The connecting lines 64 and 66 define a plurality of longitudinally disposed chambers **68*a*, 68*b*, 68*c*, 68*d*, 68*e*, and 68*f*, which for convenience will be termed contiguous. As shown, the chambers 68 extend laterally in the sheets 38 and 42, and are disposed in the longitudinal arrangement between the end edges 50*a* and 50*b*. When the sleeve is placed on the patient's leg, the lowermost chamber 68*a* is located on a lower part of the leg adjacent the patient's ankle, while the uppermost chamber 68***f* is located on an upper part of the leg adjacent the midthigh.

The lateral lines 64 define ventilation channels 70*a*, 70*b*, and 70*c* extending laterally in the sleeve from the longitudinal line 66 adjacent the side edge 48*b* toward the longitudinal line 66 adjacent the side edge 48*a*, with the ventilation channels 70 being positioned at spaced locations longitudinally along the sleeve intermediate different pairs of adjacent chambers. Thus, the ventilation channel 70*a* is located intermediate the chambers 68*a* and 68*b*, the ventilation channel 70*b* is located intermediate the chambers 68*b* and 68*c*, and the ventilation channel 70*c* is located intermediate the chambers 68*c* and 68*d*. Moreover, the ventilation channels 70 have a width substantially less than the width of the chambers 68 such that the channels 70 do not detract from the size and volume required for the compression chambers 68. The inner and outer barrier sheets 42 and 38 also define a connecting channel 74. As shown, the connecting channel 74 extends along the sides of the chambers 68*b* and 68*c*, and communicates with the ventilation channels 70*a*, *b*, and *c*, such that the channel 74 connects the spaced ventilation channels 70. Further, the inner barrier sheet 42 has a plurality of openings or apertures which communicate with the channels 70. Thus, when the sleeve 26 is placed on the patient's leg, the openings face toward the leg.

The sleeve 26 has a first connector 80*a* secured to the outer barrier sheet 38 and communicating with the first chamber 68*a*. The first connector 80*a* is connected to a first conduit 34*a* in the conduit set 34. The sleeve 26 also has a second connector 80*b* secured to the outer barrier sheet 38 and communicating with the chamber 68*c*. The second connector 80*b* is connected to a second conduit 34*b* in the conduit set 34. The sleeve 26 has a third connector 80*c* secured to the outer barrier sheet 38 and communicating with the chamber 68*e*. The third connector 80*c* is connected to a third conduit 34*c* in the conduit set 34. The sleeve 26 has a fourth connector 80*d* secured to the outer barrier sheet 38 and communicating with the channels 70 and 74. The fourth connector 80*d* is connected to a fourth conduit 34*d* in the conduit set 34. The chambers 68 are divided into three sets of adjoining chambers 68*a* and *b*, 68*c* and *d*, and 68*e* and *f*, with the conduits 80*a*, *b*, and *c* communicating with the lower chambers 68*a*, 68*c*, and 68*e*, respectively, in each of the sets.

The sleeve 26 has a plurality of openings 82*a*, 82*b*, and 82*c* communicating between the lower chamber and the upper chamber in each of the chamber sets. Thus, the opening 82*a* communicates between the chambers 68*a* and 68*b*, the opening 82*b* communicates between the chambers 68*c* and 68*d*, and the opening 82*c* communicates between the chambers 68*e* and 68*f*. During operation, the air passes through the associated conduit into the lower chamber of each set, and through the associated opening from the lower chamber into the upper chamber of each set. In this manner, the lower chamber of each set is inflated prior to the upper chamber in each set. Also, the lower chamber 68*a* in the first chamber set 68*a* and *b* is inflated prior to the lower chamber 68*c* in the second chamber set 68*c* and *d*, and the lower chamber 68*c* in the second chamber set 68*c* and *d* is inflated prior to the lower chamber 68*e* in the third chamber set 68*e* and *f*. Hence, the lower chamber 68*a* is inflated prior to the upper chamber 68*b* in the first chamber set, and the first chamber set 68*a* and *b* is inflated prior to the second chamber set 68*c* and *d*. The lower chamber 68*c* in the second chamber set is inflated prior to the upper chamber 68*d* in the second chamber set. The second chamber set 68*c* and *d* is inflated prior to the lower chamber 68*e* in the third chamber set 68*e* and *f*, and the lower chamber 68*e* is inflated prior to the upper chamber 68*f* in the third chamber set 68*e* and *f*. In this manner, a compressive pressure gradient is developed along the sleeve which decreases from the lower to upper portion of the sleeve. In suitable form during an inflation or compression cycle of the device 20, the lower chamber 68*a* is inflated during the time of zero to 2.5 seconds while the upper chamber 68*b* in the first chamber set 68*a* and *b* begins to fill at 0.1 seconds after inflation of the lower chamber 68*a* is initiated. The lower chamber 68*c* in the second chamber set 68*c* and *d* is inflated at the time of 2.5 seconds after initiation of the inflation cycle, and the upper chamber 68*d* in the second chamber set 68*c* and *d* begins to fill at 2.6 seconds after the initiation of the inflation cycle. Inflation of the lower chamber 68*e* in the third chamber set 68*e* and *f* is initiated 5.5 seconds after the start of the inflation cycle, and the upper chamber 68*f* in the third chamber set 68*e* and *f* begins to fill at 5.6 seconds after initiation of the inflation cycle.

With reference to FIGS. 2 and 4, the sleeve 26 has a plurality of elongated strips 84 of open cell foam positioned in the openings 82*a*, *b*, and *c*. The strips 84 may be constructed from a suitable foam material, such as Scott Industrial Foam, sold by Stephenson and Lawyer, Inc. of Grand Rapids, Mich. The strips 84 extend between the lower and upper chambers in each of the three chamber sets. Also, the foam strips 84 have enlarged ends 86 to prevent their dislodgment from the associated opening in the sleeve 26. The strips 84 serve to maintain the openings 82*a*, *b*, and *c* open during use of the sleeve 26, particularly when compressive forces are applied against the sleeve in the region of the openings 82*a*, *b*, and *c*. Thus, the strips 84 assure that the communication between the lower and upper chambers in each of the three chamber sets will remain in an open configuration during use of the sleeve 26. Alternatively, a rigid piece of material may be inserted into the openings to maintain them open.

In use, the sleeve 26 may be placed below the patient's leg preparatory to securement about the limb. Next, the upper flap 60 and lower flap 62 may be independently passed around the patient's leg at locations above and below the knee, respectively. Thus, the opening 56 separates the flap portions of the sleeve in the region of the knee to permit independent wrapping of the upper and lower portions of the sleeve about the leg and simplify placement of the sleeve, as well as provide an improved fit. After both the upper and lower flaps 60 and 62 have been suitably wrapped about the patient's limb, the remaining part of the sleeve adjacent the side edge 48*b* may be wrapped over the flaps 60 and 62 and the fastening strips 61 may be pressed against the fastening strips 63. Thus, the hook fastening strips 61 engage the loop fastening strips 63, such that the strips 61 and 63 interengage and retain the sleeve in the wrapped configuration. Since the strips 63 extend laterally across the outer surface of the sleeve 26, the sleeve 26 may be readily adjusted as necessary for the desired fit according to the size of the patient's leg. Thus, the sleeve 26 may be placed in a simplified manner while accomplishing an improved fit on patients having varying leg sizes. In addition, the openings 52 and 56 greatly reduce the amount of material and bulk for the sleeve 26 in the region of the patient's knee. Accordingly, the sleeve provides flexibility in the knee region in order to prevent binding and permit flexation of the knee during the extended periods of time while the sleeve is secured about the leg.

After placement of the sleeves on the patient's limbs, the controller 22 may be initiated in order to supply air to the sleeves 26. The controller 22 intermittently inflates the chambers 68 during periodic compression cycles, and intermittently deflates the chambers 68 through the exhaust tube 30 during periodic decompression cycles intermediate the compression cycles. The controller 22 also supplies air through the conduits to the connecting channels 74 in the two sleeves. The air then passes from the common connecting channel 74 to the spaced ventilation channels 70 and through the openings onto the patient's legs. In this manner, the device 20 ventilates a substantial portion of the patient's legs to prevent heat buildup and provide comfort for the patient during extended periods of time while the sleeves are retained in a wrapped configuration about the patient's limbs. In a preferred form, the controller 22 supplies air to the ventilation channel 70 during the periodic decompression cycles. Also, the controller 22 may have suitable means, such as a switch, to selectively permit passage of air to the ventilation channels 70 or prevent passage of air to the ventilation channels 70, as desired. In addition, the switch may be utilized to control the quantity of air which ventilates the patient's limbs for maximum patient comfort.

As previously discussed, the lower chambers in the three chamber sets are sequentially inflated by the controller 22. Also, the air passes from the lower chamber to the upper chamber in the three chamber sets after initiation of inflation of the lower chamber in each of the chamber sets. In this manner, the device 20 exerts a compressive pressure gradient by the sleeves 26 against the patient's limbs which decreases from the lower to upper portion of the limbs. The exertion of the pressure gradient against the patient's limb is accomplished with a simplified construction of the device 20 in order to reduce the cost of the device to the patient.

The foregoing detailed description is given for clearness of understanding only, and no unnecessary limitations should be understood therefrom, as modifications will be obvious to those skilled in the art.

We claim:

1. A device for applying compressive pressures against a patient's limb from a source of pressurized fluid comprising: an elongated pressure sleeve for enclosing a length of a patient's limb, said sleeve having a plurality of sets of adjoining, laterally extending fluid pressure chambers, each set consisting of an upper chamber and a lower chamber, said sets being progressively arranged longitudinally along the sleeve from a lower portion of the limb proximal the patient's heart, relative to said lower portion; means in said sleeve defining an opening between the adjacent upper and lower chambers of each set of chambers, each said upper chamber being otherwise closed to ingress and egress of fluid; a plurality of conduits separately communicating with only the lower chambers of each of said sets of chambers; means for intermittently inflating and deflating each of the lower chambers, only through said conduits, and thus said upper chambers, only through said opening means; and means for maintaining the opening means in said chamber sets in an open configuration comprising a piece of open cell foam positioned in and extending entirely through said openings, said foam extending from the lower to the upper chamber in each set, whereby, upon application of fluid under pressure through a selected conduit to its associated lower chamber, sequential inflation of the selected lower and upper chambers occurs with inflation of the lower chamber being initiated first and the upper chamber thereafter, only through the opening means between the selected chambers, and initiation of deflation of said chambers also occurs sequentially with initiation of deflation of the selected lower chamber occurring first and the upper chamber thereafter, only through the opening means between the selected chambers.

2. The device of claim 1 wherein the sleeve has three sets of adjoining chambers.

3. The device of claim 1 wherein the foam has an enlargement at opposed ends of the foam.

* * * * *